United States Patent [19]

Takahashi

[11] 4,433,635

[45] Feb. 28, 1984

[54] SINGLE FLUKE ANCHOR

[75] Inventor: Soroku Takahashi, Tokyo, Japan

[73] Assignee: Kyuroku Corporation, Tokyo, Japan

[21] Appl. No.: 436,648

[22] Filed: Oct. 25, 1982

Related U.S. Application Data

[63] Continuation of Ser. No. 208,336, Nov. 19, 1980, abandoned.

[51] Int. Cl.[3] ..... B63B 21/32

[52] U.S. Cl. ..... 114/301; 114/310

[58] Field of Search ..... 114/294, 301–304, 114/310; 52/155

[56] References Cited

U.S. PATENT DOCUMENTS

| | | | |
|---|---|---|---|
| Re. 21,841 | 6/1941 | Northrop et al. | 114/30 S X |
| 2,103,477 | 12/1937 | Licking | 114/301 |
| 2,507,563 | 5/1950 | Farren | 114/304 |
| 2,681,631 | 6/1954 | Brewer | 114/301 |
| 2,840,031 | 6/1958 | Kane et al. | 114/304 |
| 3,961,451 | 4/1974 | McCain | 114/301 X |

FOREIGN PATENT DOCUMENTS

| | | | |
|---|---|---|---|
| 322075 | 10/1934 | Italy | 52/155 |
| 574326 | 1/1946 | United Kingdom | 114/294 |

*Primary Examiner*—Sherman D. Basinger
*Attorney, Agent, or Firm*—Larson and Taylor

[57] ABSTRACT

A single fluke anchor for ships, structures built floating on or in the water, buoys, fishing nets and the like comprising a fluke formed integral to a shank, a stabilizer located behind the fluke and formed integral with the fluke and perpendicular to the shank, and triggers arranged integral to the both sides of the curved portion of the shank, whereby big holding power can be provided together with operation easiness.

6 Claims, 8 Drawing Figures

SINGLE FLUKE ANCHOR

This is a continuation of application Ser. No. 208,336 filed Nov. 19, 1980 now abondoned.

BACKGROUND OF THE INVENTION

Stock anchors are of the type having flukes arranged on both sides of the base of a shank and a long stock arranged at the foremost end portion of the shank and perpendicular to the shank.

Different from the stock anchors, those having a single fluke are called single fluke anchors. The conventional single fluke anchor seems like a large letter "J" or fishhook and has a long big stock arranged at the upper end of the shank and perpendicular to the shank so as to gain stable holding power for holding and mooring an object floating on or in the water, said holding power representing the force with which the anchor moors the object.

The conventional single fluke anchors like this are good in stability and have large holding power, but with the drawback that the fluke cannot be forced or easily forced into the sand on the sea bottom when anchored with its side or back on the sand or even when anchored in right shape. Therefore, the anchoring and then drawing operation of the anchor is troublesome and the pulling and then housing operation of the anchor is also troublesome because the anchor is three-dimensionally large in shape.

the appearance of a single fluke anchor having large holding power and being stable and easy to operate is now desired to moor structures floating on or in the water such as small operating boat and oil rig, buoys, fixed fishing nets and the like. The single fluke anchor of the present invention is intended to meet these needs.

SUMMARY OF THE INVENTION

The single fluke anchor of the present invention comprises a fluke formed integral to a shank, a stabilizer located behind the fluke and formed integral with the fluke and perpendicular to the shank, and triggers arranged integral to the both sides of the curved portion of the shank and is intended for use with vessels, particularly small ones, structures built floating on or in the water such as oil rig, buoys, fixed fishing nets and the like. This anchor can always be returned to its normal position by a further drawing thereof even when or after it is anchored anchored with its side or back on the sand and thereby allow the fluke to be forced into the sand to stably moor the object with the maximum holding power.

An object of the present invention is therefore to provide a single fluke anchor excellent in its holding power and stable at the time of mooring.

Another object of the present invention is to provide a single fluke anchor capable of being always returned to its normal position even when initially anchored in the wrong position.

A further object of the present invention is to provide a single fluke anchor easy to anchor and to further draw after being anchored.

A still further object of the present invention is to provide a single fluke anchor useful for vessels, particularly small ones.

A still further object of the present invention is to provide a single fluke anchor useful for structures built on the sea bottom or floating on or in the water, buoys, fishing nets, fixed fishing nets, and the like.

A still further object of the present invention is to provide a single fluke anchor excellent in strength.

These and other objects of the present invention can be achieved by the arrangement and operation of the single fluke anchor of the present invention, and some embodiments will become apparent from the following detailed description with reference to the accompanying drawings. It should be understood that all changes and modifications added to the detail of the single fluke anchor are included in the scope of the claims attached hereto.

DETAILED DESCRIPTION OF THE PREFERRED EMBODIMENTS

FIGS. 1 through 4 show the whole of a single fluke anchor A of the present invention. The anchor includes a "J"—or fishhook—shaped shank 1 when viewed from the side thereof, and a fluke 2 formed integral to the lower end of the shank 1, said fluke having a tip portion 2*a* formed acute and a rim 2*b* edged acute from the back thereof. Formed integral to the base of the fluke 2 is a stabilizer 3 having same area as the surface area of the fluke 2 and perpendicular to the shank 1. It is desirable to make angle $\alpha$ about 140 degrees which angle is formed by the sides of the fluke 2 and stabilizer 3 (see FIG. 2).

Figure 1:
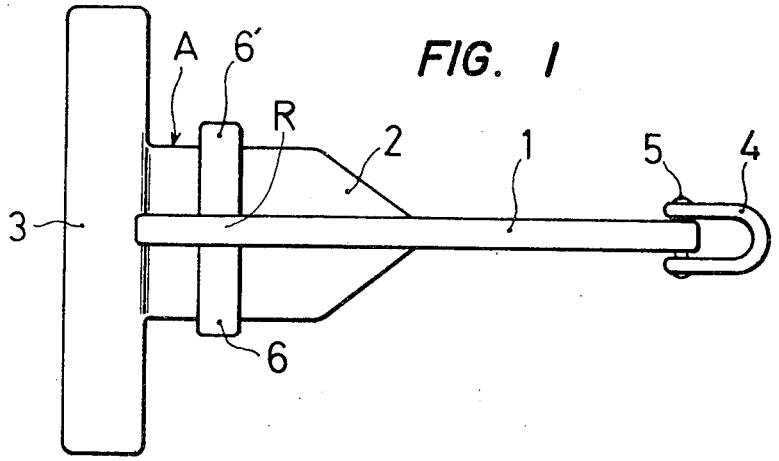
FIG. 1 is a plane view showing a single fluke anchor of the present invention.
Figure 3:
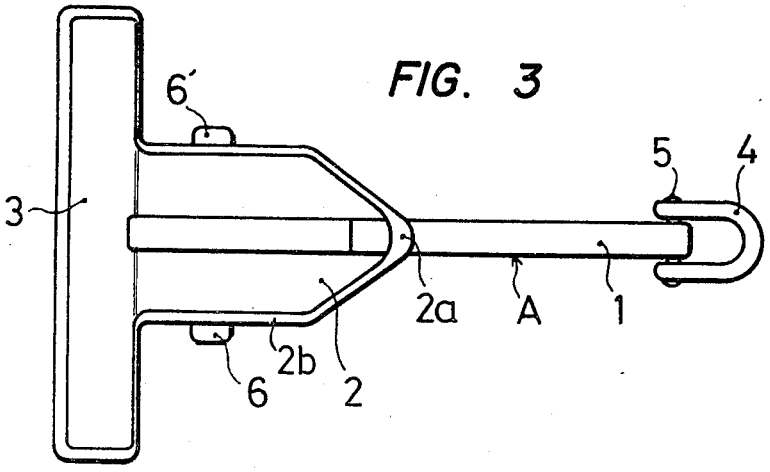
FIG. 3 is a view taken from the bottom of the anchor shown in FIG. 1.
Figure 2:
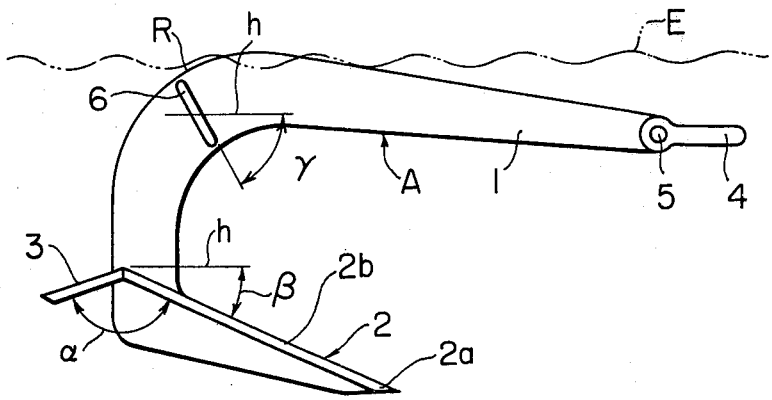
FIG. 2 is a side view of the anchor shown in FIG. 1 and showing the anchor embedded in the sand particularly on the sea bed.

The anchor of the present invention has such arrangement that the J-shaped shank 1 is formed integral to the center of the fluke 2. As shown in FIG. 2, the angle $\beta$ of the fluke 2 relative to the horizontal line h of the anchor A is made about 25 degrees. Freely rotatably attached through a pin 5 to the foremost end of the shank 1 is an anchor ring 4 for connecting a chain or rope.

Figure 4:
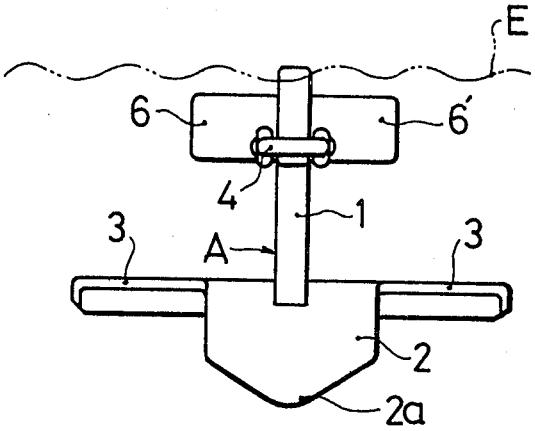
FIG. 4 is a front view of the anchor shown in FIG. 1 and showing the anchor embedded in the sand on the sea bed similarly as in FIG. 2.

Fixed integral to the both sides of the curved portion R of the shank 1 are triggers 6 and 6' having an area about half the surface area of the stabilizer 3, and the angle $\gamma$ thereof relative to the horizontal line h of the anchor A made about 60 degrees. The two-dotted wave line shown in FIGS. 2, 4, 5*a* and 5*b* represents the sand surface E on the sea bed and the anchor A embedded in the sand as shown in FIGS. 2 and 4 serves to moor an object.

In whatever position it may be anchored and in whatever direction force may be directed to the anchor ring 4 attached to the foremost end of its shank 1, the anchor A of the present invention allows its fluke 2 to be forced into the sand on the sea bed to become ready to hold and moor the object. With the fluke 2 spaced remote from the shank 1 and with a long and large surface area, fluke 2 is therefore allowed to deeply cut into the sand on the sea bed. When once under such state, the anchor A of the present invention is stabilized by the stabilizer 3 not to be shifted to a wrong position even if any undesired big force is applied to the anchor A, to thereby provide high stable holding power.

Even when anchored with its side or back on the sand or turned to cause its side or back to be on the sand by a stepped portion on the sea bed at the time of being drawn in the water, the anchor A can be instantly returned to its normal position to hold and moor the object because the force applied to the curved portion R of the shank 1 when the anchor is further pulled in the forward direction causes the whole of the anchor to be rotated and serves to always return the whole of the anchor to its normal position.

Figure 5A:
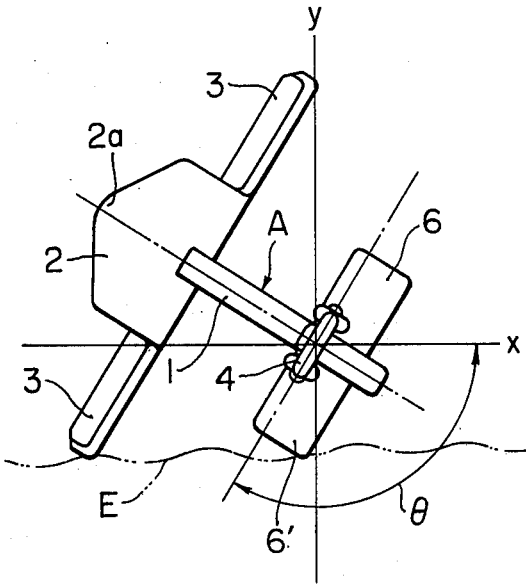
FIGS. 5*a* and 5*b* are views showing how the single fluke anchor of the present invention is operated.
Figure 5B:
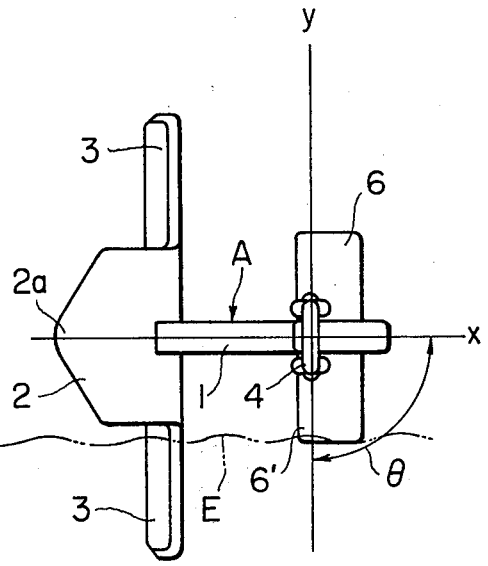

When axes x and y are plotted relative to the anchor A as shown in FIG. 5*a* and an axis z is further imagined vertical to the drawing surface with the center of the anchor ring 4 located on the axis z, the whole of the anchor A is always forced to return to its normal position by the arrangement of the anchor A in spite of the angle $\theta$of the anchor shifted from its normal position.

This is achieved particularly by the stabilizer 3 and triggers 6, 6'. When the anchor A is anchored in wrong position to generate the fallen angle $\theta$of the anchor A, the fallen angle $\theta$of the anchor A is made about 120 degrees, as shown in FIG. 5*a*, by a forward pulling of the whole anchor A. This is the state where the stabilizer 3 is contacted with the sand surface E. When further pulled in the forward direction, the anchor A is rotated cutting into the sand because of the stabilizer 3 being formed at the angle $\alpha$ relative to the fluke 2 (see FIG. 5*b*). When the anchor A is rotated to make the fallen angle $\theta$ about 90 degrees without triggers 6 and 6' attached to the anchor A, the plane of the stabilizer 3 is made approximately parallel to the direction in which the anchor A is pulled, thus making smaller the force applied to the stabilizer 3 to cause the whole anchor A to difficultly return to its normal position. However, the triggers 6 and 6' having the angle $\alpha$ relative to the anchor A and arranged reverse to the stabilizer 3 cause the whole anchor A to generate resistance and prevent the plane of the stabilizer 3 from being made parallel to the direction in which the anchor A is pulled. This induces the action of the stabilizer 3, thus applying to the shank 1 a force for always returning the whole anchor A to its normal position and forcing the fluke 2 to rightly cut into the sand. The stabilizer 3 now serves to hold the whole anchor A completely stable in such a way that the anchor A can hold and moor the object with the maximum holding power.

The anchor A of the present invention can cut reliably into any kinds of soil on the sea bed such as sand, mud and clay and has high reliability since it always operates when anchored. It has been found that even when anchored with its side or back on the sand the anchor A allows its fluke 2 to be reliably forced into the sand on the sea bed by pulling the anchor A about two times the length of the shank 1.

When anchored, it is enough only to throw the anchor A in the water without considering the throwing shape and direction thereof.

The length of the mooring rope connected to the anchor ring 4 of the anchor A can be made substantially short, only 2.5 times the depth of water.

The action of the stabilizer 3 and triggers 6, 6' serves to prevent the anchor A from being too deeply cut into the sand on the sea bed, thus making it easy to pull the anchor A over the water.

The anchor A of the present invention can be made integral of iron, so that it is excellent in strength and easy to make.

Figure 6:
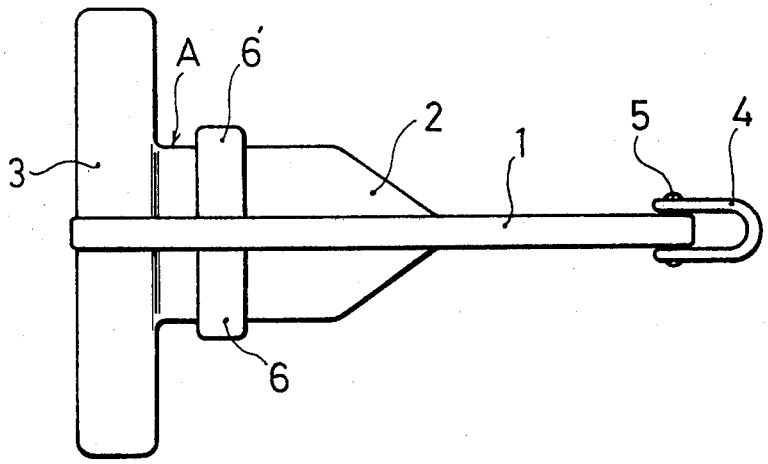
FIG. 6 is a plane view showing another single fluke anchor of the present invention.
Figure 7:
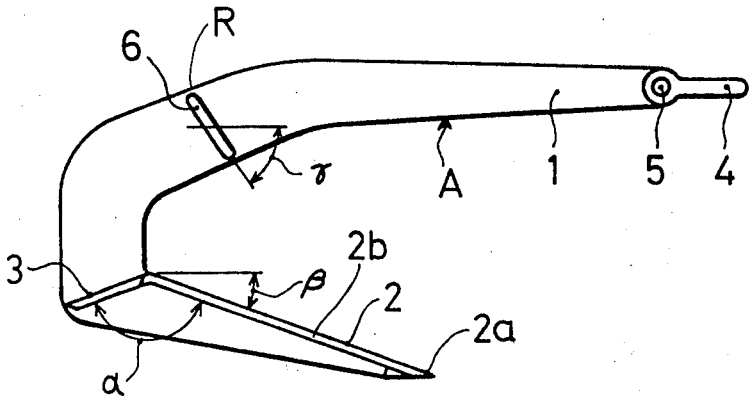
FIG. 7 is a side view of the anchor shown in FIG. 6.

FIGS. 6 and 7 show another anchor of the present invention in which one end following the curved portion R of the shank 1 is made broader in the side thereof and the stabilizer 3 is within the width of the broad side when viewed from the side of the anchor, thus making it easy to attach the stabilizer 3 to the shank 1.

I claim:

1. A single fluke anchor for ships, structures built on or in the water, buoys, fishing nets, and the like comprising:

a generally J-shaped defining a vertical plane with the straight portion extending frontally and horizontally and with the curved portion located below the straight portion;

a fluke formed integral to said shank at the free end of the curved portion and extending laterally therefrom, said fluke having a forward and downward inclination;

a generally flat stabilizer located behind said fluke and formed integral with said fluke, said stabilizer having a rearward and downward inclination and extending laterally beyond both sides of said fluke; and a generally planar trigger integrally formed on each side of said shank at the end of the curved portion connected to the straight portion, each said trigger extending slightly laterally beyond the respective sides of said fluke and having a width narrower than the corresponding width of the curved portion from which each said trigger extends.

2. A single fluke anchor according to claim 1 wherein one end following the curved portion of the shank is made broader in the side thereof and the stabilizer is arranged within the width of the broad side.

3. A single fluke anchor according to claim 2 wherein said triggers extend generally upwardly and rearwardly.

4. A single fluke anchor according to claim 1 wherein said triggers extend generally upwardly and rearwardly.

5. A single fluke anchor according to claim 1 wherein said triggers are located forwardly of the rearmost end of said fluke.

6. A single fluke anchor according to claim 1 wherein the surface area of said fluke is approximately the same as the surface area of said stabilizer.

* * * * *